US005685251A

United States Patent [19]

Halko

[11] Patent Number: 5,685,251

[45] Date of Patent: Nov. 11, 1997

[54] WATER JET POWERED BOAT BOTTOM CLEANING SYSTEM

[76] Inventor: John J. Halko, 2889 Upper Bethany Rd.,, Jasper, Ga. 30143

[21] Appl. No.: 723,783

[22] Filed: Sep. 30, 1996

[51] Int. Cl.[6] ..... B63B 59/00

[52] U.S. Cl. ..... 114/222; 15/1.7

[58] Field of Search ..... 114/222; 15/1.7, 15/22 R

[56] References Cited

U.S. PATENT DOCUMENTS

| | | | |
|---|---|---|---|
| 693,242 | 2/1902 | Culpepper | 114/222 |
| 3,707,737 | 1/1973 | Brower | 114/222 |
| 4,102,290 | 7/1978 | Weiss | 114/222 |

*Primary Examiner*—Jesus D. Sotelo

[57] ABSTRACT

A new Water Jet Powered Boat Bottom Cleaning System for facilitating efficient removal of barnacles and other accumulated debris from the bottom of boats by applying an upward force from a buoyant boule shaped member coupled with the force exerted by a plurality of water jets to an interchangeable scraper blade during reciprocating movement caused by the user against the bottom of the boat. The inventive device includes a telescoping handle member, a hose coupler secured at the lower end of the telescoping handle member and coupling to a water hose, a first water tube secured to the hose coupler opposite of the telescoping handle member, at least one elbow tube member secured to the first water tube opposite of the hose coupler, and a scraping head including an interchangeable scraper blade forced against the bottom side of a boat by a buoyant boule shaped member and a plurality of water jets discharging water from the water hose.

6 Claims, 3 Drawing Sheets

WATER JET POWERED BOAT BOTTOM CLEANING SYSTEM

BACKGROUND OF THE INVENTION

1. Field of the Invention

The present invention relates to Boat Bottom Cleaning Devices and more particularly pertains to a new Water Jet Powered Boat Bottom Cleaning System for facilitating efficient removal of barnacles and other accumulated debris from the bottom of boats by applying an upward force from a buoyant boule shaped member coupled with the force exerted by a plurality of water jets to an interchangeable scraper blade during reciprocating movement caused by the user against the bottom of the boat.

2. Description of the Prior Art

The use of Boat Bottom Cleaning Devices is known in the prior art. More specifically, Boat Bottom Cleaning Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Boat Bottom Cleaning Devices include U.S. Pat. Nos. 5,209,176; 5,105,752; 4,991,533; 4,909,173; 4,926,775 and U.S. Pat. No. Des. 336,783.

While these devices fulfill their respective, particular objectives and requirements, the aforementioned patents do not disclose a new Water Jet Powered Boat Bottom Cleaning System. The inventive device includes a telescoping handle member, a hose coupler secured at the lower end of the telescoping handle member and coupling to a water hose, a first water tube secured to the hose coupler opposite of the telescoping handle member, at least one elbow tube member secured to the first water tube opposite of the hose coupler, and a scraping head including an interchangeable scraper blade forced against the bottom side of a boat by a buoyant bottle shaped member and a plurality of water jets discharging water from the water hose.

in these respects, the Water Jet Powered Boat Bottom Cleaning System according to the present invention substantially departs from the conventional concepts and designs of the prior art, and in so doing provides an apparatus primarily developed for the purpose of facilitating efficient removal of barnacles and other accumulated debris from the bottom of boats by applying an upward force from a buoyant boule shaped member coupled with the force exerted by a plurality of water jets to an interchangeable scraper blade during reciprocating movement caused by the user against the bottom of the boat.

SUMMARY OF THE INVENTION

In view of the foregoing disadvantages inherent in the known types of Boat Bottom Cleaning Devices now present in the prior art, the present invention provides a new Water Jet Powered Boat Bottom Cleaning System construction wherein the same can be utilized for facilitating efficient removal of barnacles and other accumulated debris from the bottom of boats by applying an upward force from a buoyant boule shaped member coupled with the force exerted by a plurality of water jets to an interchangeable scraper blade during reciprocating movement caused by the user against the bottom of the boat.

The general purpose of the present invention, which will be described subsequently in greater detail, is to provide a new Water Jet Powered Boat Bottom Cleaning System apparatus and method which has many of the advantages of the Boat Bottom Cleaning Devices mentioned heretofore and many novel features that result in a new Water Jet Powered Boat Bottom Cleaning System which is not anticipated, rendered obvious, suggested, or even implied by any of the prior art Boat Bottom Cleaning Devices, either alone or in any combination thereof.

To attain this, the present invention generally comprises a telescoping handle member, a hose coupler secured at the lower end of the telescoping handle member and coupling to a water hose, a first water tube secured to the hose coupler opposite of the telescoping handle member, at least one elbow tube member secured to the first water tube opposite of the hose coupler, and a scraping head including an interchangeable scraper blade forced against the bottom side of a boat by a buoyant boule shaped member and a plurality of water jets discharging water from the water hose.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Water Jet Powered Boat Bottom Cleaning System apparatus and method which has many of the advantages of the Boat Bottom Cleaning Devices mentioned heretofore and many novel features that result in a new Water Jet Powered Boat Bottom Cleaning System which is not anticipated, rendered obvious, suggested, or even implied by any of the prior art Boat Bottom Cleaning Devices, either alone or in any combination thereof.

It is another object of the present invention to provide a new Water Jet Powered Boat Bottom Cleaning System which may be easily and efficiently manufactured and marketed.

It is a further object of the present invention to provide a new Water Jet Powered Boat Bottom Cleaning System which is of a durable and reliable construction.

An even further object of the present invention is to provide a new Water Jet Powered Boat Bottom Cleaning System which is susceptible of a low cost of manufacture with regard to both materials and labor, and which accordingly is then susceptible of low prices of sale to the consuming public, thereby making such Water Jet Powered Boat Bottom Cleaning System economically available to tile buying public.

Still yet another object of the present invention is to provide a new Water Jet Powered Boat Bottom Cleaning System which provides in the apparatuses and methods of the prior art some of the advantages thereof, while simultaneously overcoming some of the disadvantages normally associated therewith.

Still another object of the present invention is to provide a new Water Jet Powered Boat Bottom Cleaning System for facilitating efficient removal of barnacles and other accumulated debris from the bottom of boats by applying an upward force from a buoyant boule shaped member coupled with the force exerted by a plurality of water jets to an interchangeable scraper blade during reciprocating movement caused by the user against the bottom of the boat.

Yet another object of the present invention is to provide a new Water Jet Powered Boat Bottom Cleaning System which includes a telescoping handle member, a hose coupler secured at the lower end of the telescoping handle member and coupling to a water hose, a first water tube secured to the hose coupler opposite of the telescoping handle member, at least one elbow tube member secured to the first water tube opposite of the hose coupler, and a scraping head including an interchangeable scraper blade forced against tile bottom side of a boat by a buoyant boule shaped member and a plurality of water jets discharging water from the water hose.

Still yet another object of the present invention is to provide a new Water Jet Powered Boat Bottom Cleaning System that is adjustable to the contours of the hull of a boat.

Even still another object of the present invention is to provide a new Water Jet Powered Boat Bottom Cleaning System that can be utilized from a dock or from the deck of the boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
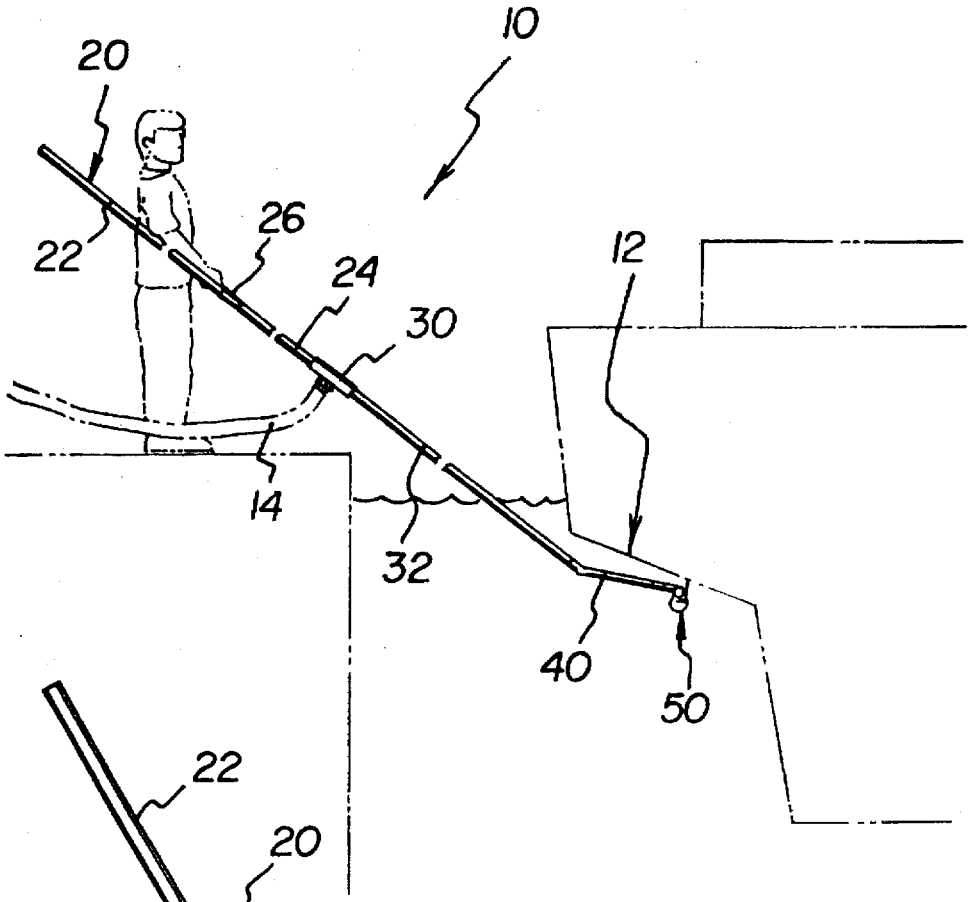
FIG. 1 is a right side view of a new Water Jet Powered Boat Bottom Cleaning System according to the present invention.
Figure 2:
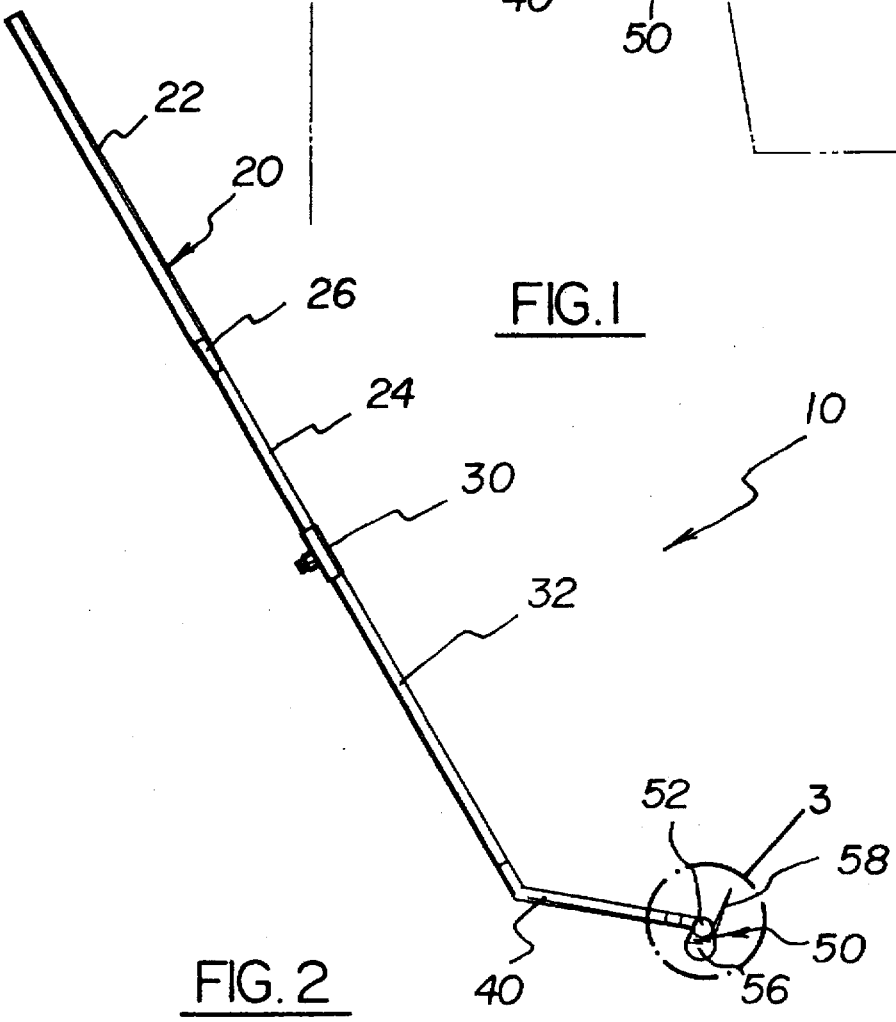
FIG. 2 is a right side view thereof.
Figure 4:
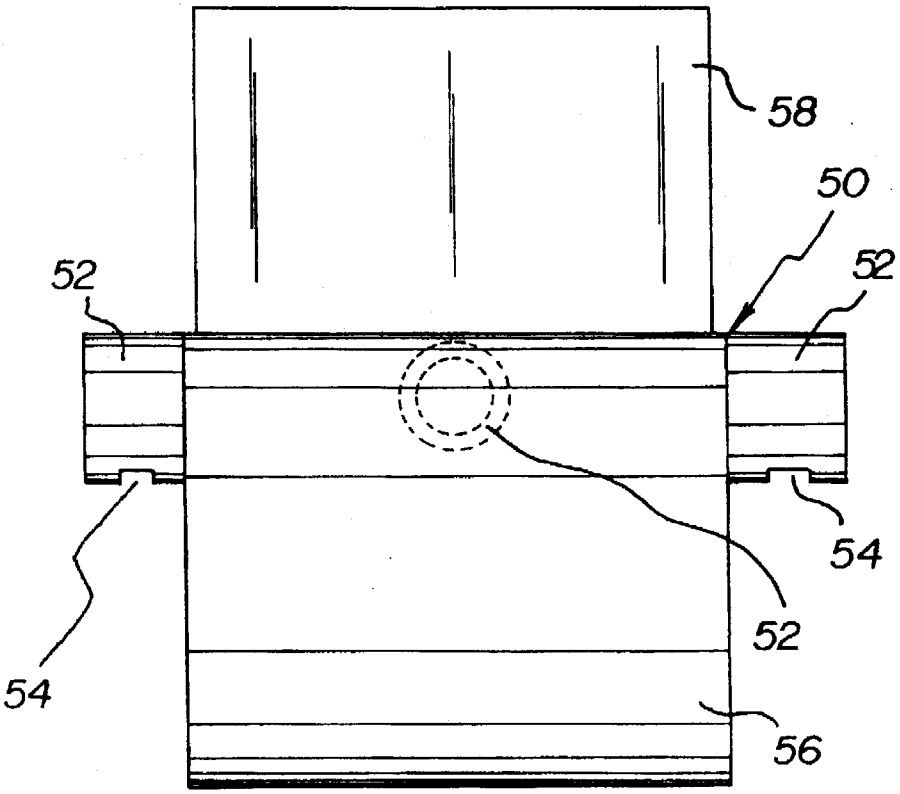
FIG. 4 is a cross sectional view taken along line 4—4 of FIG. 3.
Figure 3:
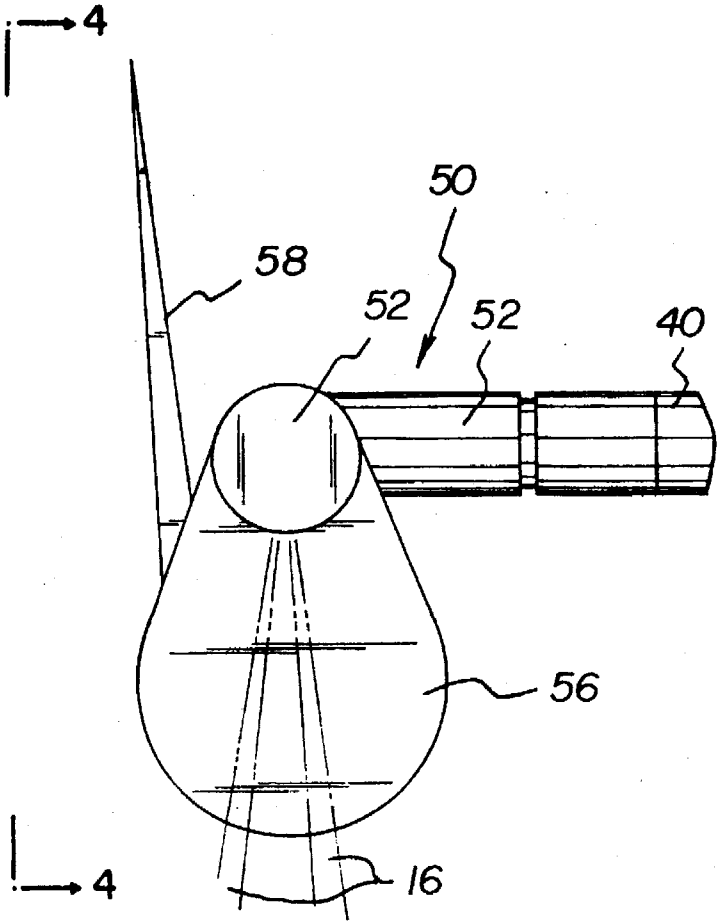
FIG. 3 is a magnified side view of the scraping head.
Figure 6:
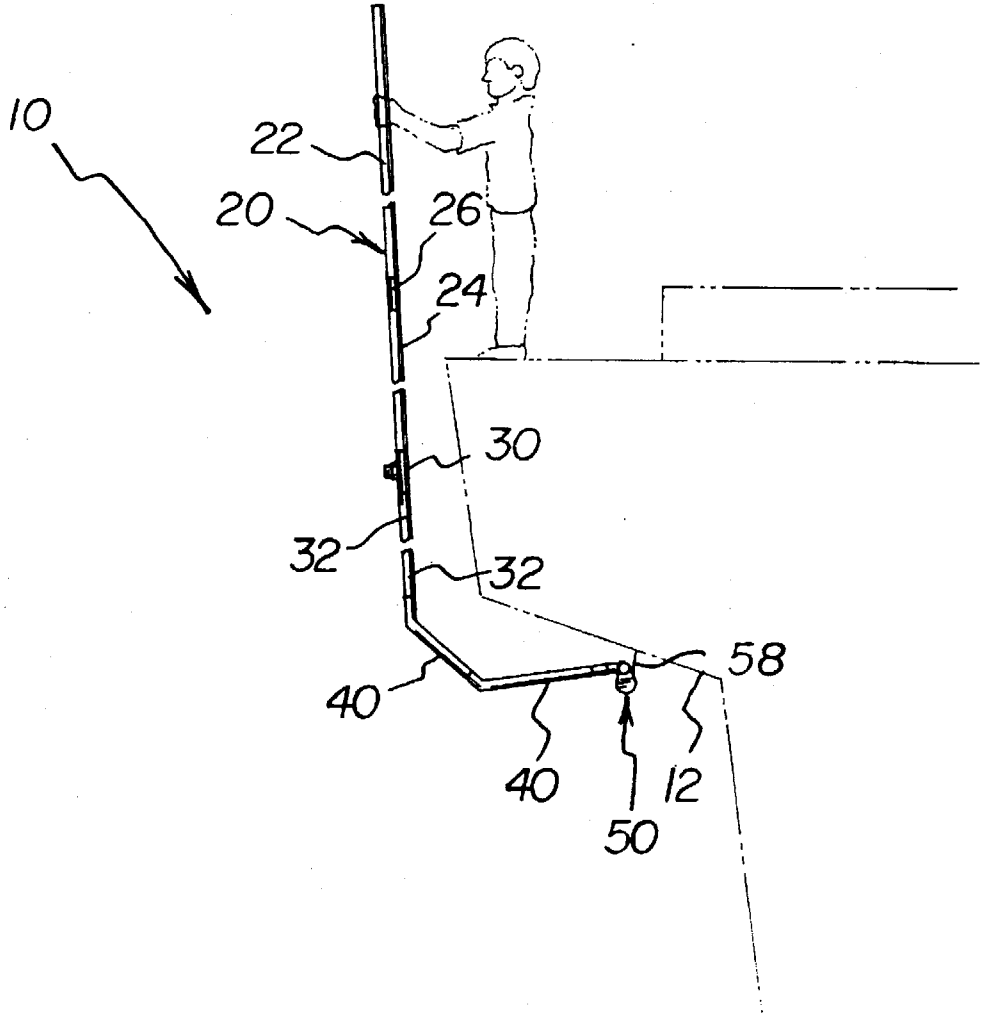
FIG. 6 is a side view of the present invention engaging the bottom of a boat.
Figure 5:
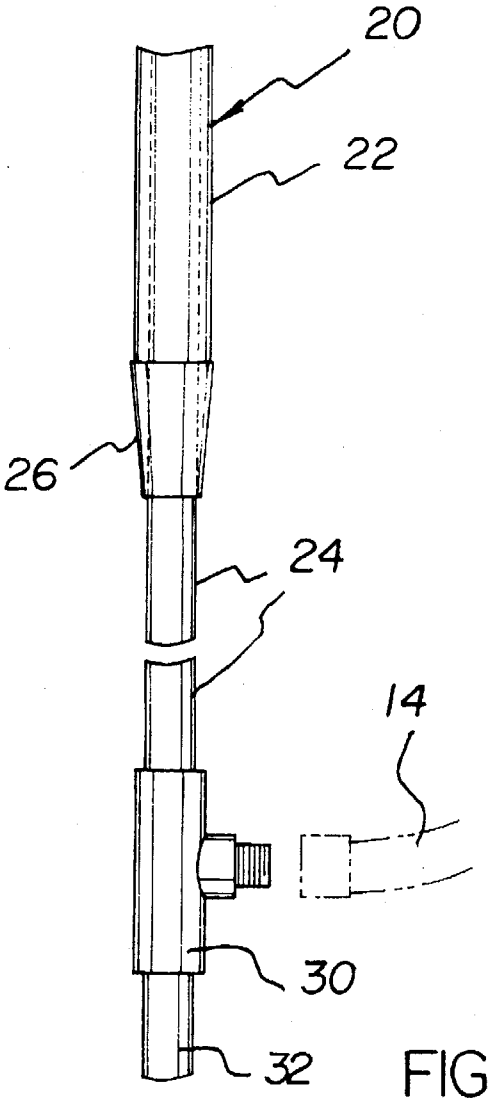
FIG. 5 is a magnified view of the hose coupler.

With reference now to the drawings, and in particular to FIGS. 1 through 6 thereof, a new Water Jet Powered Boat Bottom Cleaning System embodying the principles and concepts of the present invention and generally designated by the reference numeral 10 will be described.

More specifically, it will be noted that the Water Jet Powered Boat Bottom Cleaning System 10 comprises a telescoping handle member 20, a hose coupler 30 secured to an end of the telescoping handle member 20 and engaging a water hose 14 on the side portion, a first water tube 32 secured to the hose coupler 30 opposite of the telescoping handle member 20 and projecting along the longitudinal axis of said telescoping handle member 20, at least one elbow tube member 40 secured in a series to the first water tube 32 opposite of the hose coupler 30, and a scraping head 50 secured to the end of the last elbow tube member 40 farthest from the first water tube 32 which engages the boat bottom 12 for removing barnacles and other accumulated debris.

As best illustrated in FIGS. 1 through 6, it can be shown that the telescoping handle member 20 includes an outer member 22. A telescoping lock 26 is rotatably secured to one end of the outer member 22. An inner member 24 is slidably projecting into the outer member 22 through the end including the telescoping lock 26, thereby retained in a desired position by the telescoping lock 26. The scraping head 50 includes a pivoting T-end 52 which pivotally engages the last elbow tube member 40. A buoyant boule shaped member 56 is secured to the bottom side of the pivoting T-end 52 where the pivoting T-end 52 is wider as best disclosed in FIGS. 3 and 4 of the drawings. An interchangeable scraper blade 58 is secured to the buoyant boule shaped member 56 projecting upward and parallel to the front surface of the buoyant boule shaped member 56. Said pivoting T-end 52 includes a plurality of water jets 54 in the bottom surface near the extended ends. The water jets 54 discharge water away from the end of the interchangeable scraper blade 58 that engages the boat bottom 12. The elbow tube member 40 preferably has an inner angle bend of forty-five degrees. The telescoping handle member 20 is preferably eight feet in length when fully extended and four feet in length when retracted. The first water tube 32 is preferably four feet in length.

In use, the user extends the telescoping handle member 20 to the required length to so as to allow the scraping head 50 to engage the boat bottom 12. The user then opens the water hose 14 which is coupled to the hose coupler 30 to allow flow of water through the first water tube 32 into the series of elbow tube members 40 finally discharged through the water jets 54 within the pivoting T-end when submerged within the water below the boat bottom 12. The buoyancy of the buoyant boule shaped member 56 coupled with the force from the water discharge through the water jets 54 forces the interchangeable scraper blade 58 against the boat bottom 12. The user reciprocates the present invention thereby removing the accumulated barnacles and other debris from the boat bottom 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Water Jet Powered Boat Bottom Cleaning System comprising:

a telescoping handle member;

a hose coupler secured to an end of the telescoping handle member and engaging a water hose on the side portion;

a first water tube secured to the hose coupler opposite of the telescoping handle member and projecting along the longitudinal axis of said telescoping handle member;

at least one elbow tube member secured in a series to the first water tube opposite of the hose coupler; and a scraping head secured to the end of the last elbow tube member farthest from the first water tube which engages the boat bottom for removing barnacles and other accumulated debris.

2. The Water Jet Powered Boat Bottom Cleaning System of claim 1, wherein the telescoping handle member includes:

an outer member;

a telescoping lock rotatably secured to one end of the outer member; and an inner member slidably projecting into the outer member through the end including the telescoping lock, thereby retained in a desired position by the telescoping lock.

3. The Water Jet Powered Boat Bottom Cleaning System of claim 2, wherein the scraping head includes:

a pivoting T-end which pivotally engages the last elbow tube member;

a buoyant boule shaped member secured to the bottom side of the pivoting T-end where the pivoting T-end is wider;

an interchangeable scraper blade secured to the buoyant boule shaped member projecting upward and parallel to the front surface of the buoyant boule shaped member; and said pivoting T-end including a plurality of water jets in the bottom surface near the extended ends, where the water jets discharge water away from the end of the interchangeable scraper blade end that engages the boat bottom.

4. The Water Jet Powered Boat Bottom Cleaning System of claim 3, wherein the elbow tube member has an inner angle bend of forty-five degrees.

5. The Water Jet Powered Boat Bottom Cleaning System of claim 4, wherein the telescoping handle member is eight feet in length when fully extended and four feet in length when retracted.

6. The Water Jet Powered Boat Bottom Cleaning System of claim 5, wherein the first water tube is four feet in length.

* * * * *